US007497568B2

(12) United States Patent
Kudoh

(10) Patent No.: US 7,497,568 B2
(45) Date of Patent: Mar. 3, 2009

(54) IMAGE FORMING APPARATUS

(75) Inventor: Taku Kudoh, Kanagawa (JP)

(73) Assignee: Ricoh Company, Ltd, Tokyo (JP)

( * ) Notice: Subject to any disclaimer, the term of this patent is extended or adjusted under 35 U.S.C. 154(b) by 405 days.

(21) Appl. No.: 11/359,861

(22) Filed: Feb. 21, 2006

(65) Prior Publication Data

US 2006/0187245 A1 Aug. 24, 2006

(30) Foreign Application Priority Data

Feb. 24, 2005 (JP) ..... 2005-048436

(51) Int. Cl.
*B41J 2/01* (2006.01)

(52) U.S. Cl. ..... 347/104

(58) Field of Classification Search ..... 347/2, 347/29, 30, 85, 101, 104, 108; 399/2, 37
See application file for complete search history.

(56) References Cited

U.S. PATENT DOCUMENTS

| | | | | |
|---|---|---|---|---|
| 5,561,500 | A * | 10/1996 | Ohzeki et al. | 399/85 |
| 6,151,037 | A * | 11/2000 | Kaufman et al. | 347/2 |
| 6,471,351 | B1 * | 10/2002 | Ishikawa et al. | 347/104 |
| 6,582,039 | B2 | 6/2003 | Johnson et al. | |
| 6,682,190 | B2 * | 1/2004 | Rasmussen et al. | 347/104 |

FOREIGN PATENT DOCUMENTS

| | | |
|---|---|---|
| EP | 0419876 A1 | 4/1991 |
| JP | 7047670 | 2/1995 |
| JP | 7089161 | 4/1995 |
| JP | 2000-263898 | 9/2000 |
| JP | 2001-318494 | 11/2001 |
| JP | 2002-192711 | 7/2002 |
| JP | 2003-118174 | 4/2003 |
| JP | 2004-9404 | 1/2004 |
| JP | 2004-284084 | 10/2004 |
| JP | 2005-89125 | 4/2005 |

OTHER PUBLICATIONS

Nov. 16, 2007 Chinese official action (with English translation) in connection with Chinese patent application No. 2006100673647.

* cited by examiner

*Primary Examiner*—Anh T. N. Vo
(74) *Attorney, Agent, or Firm*—Cooper & Dunham, LLP

(57) ABSTRACT

An image forming apparatus comprises a body, an engine part provided in the body and including a recording head that ejects droplets of a recording liquid, the engine part recording an image on a recording medium by the recording head while feeding the recording medium in a main scanning direction, a medium discharging part provided in the body at a side of the engine part, the medium discharging part feeding the recording medium to a medium take-up part after recording of the image with the engine, and a cartridge loading part that holds a cartridge of the recording liquid in a detachable manner, the cartridge loading part being provided in the body of the image forming apparatus and feeding the recording liquid to the recording head of the engine part, wherein the cartridge loading part is provided underneath the medium discharging part.

7 Claims, 11 Drawing Sheets

IMAGE FORMING APPARATUS

BACKGROUND

This disclosure relates to image forming apparatuses and more particularly to an image forming apparatus that forms images by means of a recording head that ejects droplets of a recording liquid.

Conventionally, there is a multifunctional image forming apparatus that integrates the function of printer, facsimile and copying machine by using the technology of electron photography for the image forming part thereof.

Further, there is a multifunctional image forming apparatus that uses the technology of ink-jet recording for the image forming part. With the recording apparatus of this type, a recording head that ejects droplets of a recording liquid called also as "ink", is used for forming images on a medium, which is called also as "recording sheet", "recording medium", "recording object", or the like, wherein such recording of images is called "recording", "printing", "reprography", "character printing", or the like.

[Patent Reference 1]

Japanese Laid-Open Patent Application 2002-192711.

Patent Reference 1 discloses a conventional image forming apparatus that disposes an ink cartridge (ink tank) underneath a sheet discharging tray. Thereby, an ink is supplied to a sub-tank mounted upon a carriage together with a recording head from such an ink cartridge.

[Patent Reference 2]

Japanese Laid-Open Patent Application 2004-9404

Further, Patent Reference 2 discloses a construction of image forming apparatus in which the medium formed with an image with a recording head is directly discharged to a discharging tray disposed inside the image forming apparatus.

[Patent Reference 3]

Japanese Laid-Open Patent Application 2001-318494

Further, Patent Reference 3 discloses a construction that enables both face-down sheet discharging and face-up sheet discharging.

With an image forming part that uses an ink-jet process, it is inevitable to provide a mechanism for maintaining and recovering the performance of the recording head that ejects droplets of the recording liquid, wherein it should be noted that the mechanism of maintenance generally includes a humidity maintenance cap that tightly covers the nozzle surface for preventing increase of viscosity of the recording liquid caused by evaporation of the recording liquid, a suction cap, serving sometimes also for the humidity maintenance cap, for sucking and discharging the viscous recording liquid from the nozzle, a wiper blade, called also as "cleaning blade", "wiper", "blade member", or "blade", for wiping away the recording liquid adhered to the nozzle surface, a dummy ejection part for conducting dummy ejection of the liquid droplets without forming images, and the like.

In the case of the recording apparatus that employs serial scanning process that carries out formation of images on a sheet by causing the recording head to scan over the sheet in a main scanning direction in the state the recording head is mounted upon a carriage, it is practiced to dispose the maintenance and recovery mechanism at an end of the main scanning direction. Further, it is practiced to dispose the dummy ejection part on an end part of the main scanning direction for recovering the nozzle used for recording. Alternately, the maintenance and recovery mechanism is provided at both ends of the main scanning direction as set forth in Patent Reference 4.

[Patent Reference 4]

Japanese Laid-Open Patent Application 2004-284084

In conventional approaches aches of constructing the image forming part to carry our image formation by the serial scanning process of liquid ejection head, however, there arises a problem in that the overall size of the apparatus is increased in view of the fact that it is necessary to provide the maintenance and recovery mechanism or dummy ejection part at one end or both ends of the carriage main scanning direction.

Further, while the printing speed itself can be increased with recent image forming apparatuses, there is a need of securing time for drying the recording liquid on the recording medium with such an image forming apparatus as long as the image formation is conducted by using a recording liquid. With this regard, the image forming apparatus that discharges the recording sheet while carrying out image recording simultaneously as taught by Patent Reference 1 or 2 cannot provide sufficient time for drying the recording liquid and tends to cause degradation of recorded images due to rubbing when the printing speed is increased. Thus there has been imposed limitation in the improvement in the printing speed.

BRIEF SUMMARY

In an aspect of this disclosure, an image forming apparatus is provided that can reduce the size of the apparatus while at the same time securing sufficient time for drying the recording liquid on the image forming medium after image formation thereon.

In an exemplary embodiment of this disclosure, there is provided, an image forming apparatus comprising a body, an engine part provided in said body, said engine part including a recording head that ejects droplets of a recording liquid, said engine part recording an image on a recording medium by said recording head while feeding said recording medium to said recording head, a medium discharging part provided in said body at a side of said engine part, said medium discharging part feeding said recording medium to a medium take-up part after recording of said image with said engine, and a cartridge loading part that holds a cartridge of said recording liquid in a detachable manner, said cartridge loading part being provided in said body of said image forming apparatus and feeding said recording liquid to said recording head of said engine part, wherein said cartridge loading part is provided underneath said medium discharging part.

In a preferred embodiment, said engine part forms a unit detachable to and from said body of said image forming apparatus. In another preferred embodiment, said engine part includes a maintenance and recovery mechanism that maintains said recording head operational. In a further preferred embodiment, there is further provided with a sheet discharging part that discharges said recording medium fed with said medium discharging part in a turned-over state. In a further preferred embodiment, said cartridge loading part is disposed at a front side of said body, said image forming apparatus including a part that generates heat such that said part is provided in said body at a rear side of said body. In a further preferred embodiment, the part that generated heat is disposed opposite to said cartridge loading part. In a further preferred embodiment, said part that generates heat is at least one of a power supply unit and a control board of said image forming apparatus.

According to the image forming apparatus of the present invention, it becomes possible to secure the time for drying the recording liquid on the recording sheet, on which image formation has been made, as the recording medium is fed by the medium discharging part disposed sideways to the image forming engine. Further, it becomes also possible to use the dead space underneath the medium discharging part by disposing the cartridge loading part therein.

Thus, it becomes possible with the present invention to secure the time for drying the recording liquid on the recording medium after image formation while reducing the size of the image forming apparatus.

DETAILED DESCRIPTION OF THE INVENTION

Hereinafter, the present invention will be explained by an embodiment with reference to the drawings.

Figure 1:
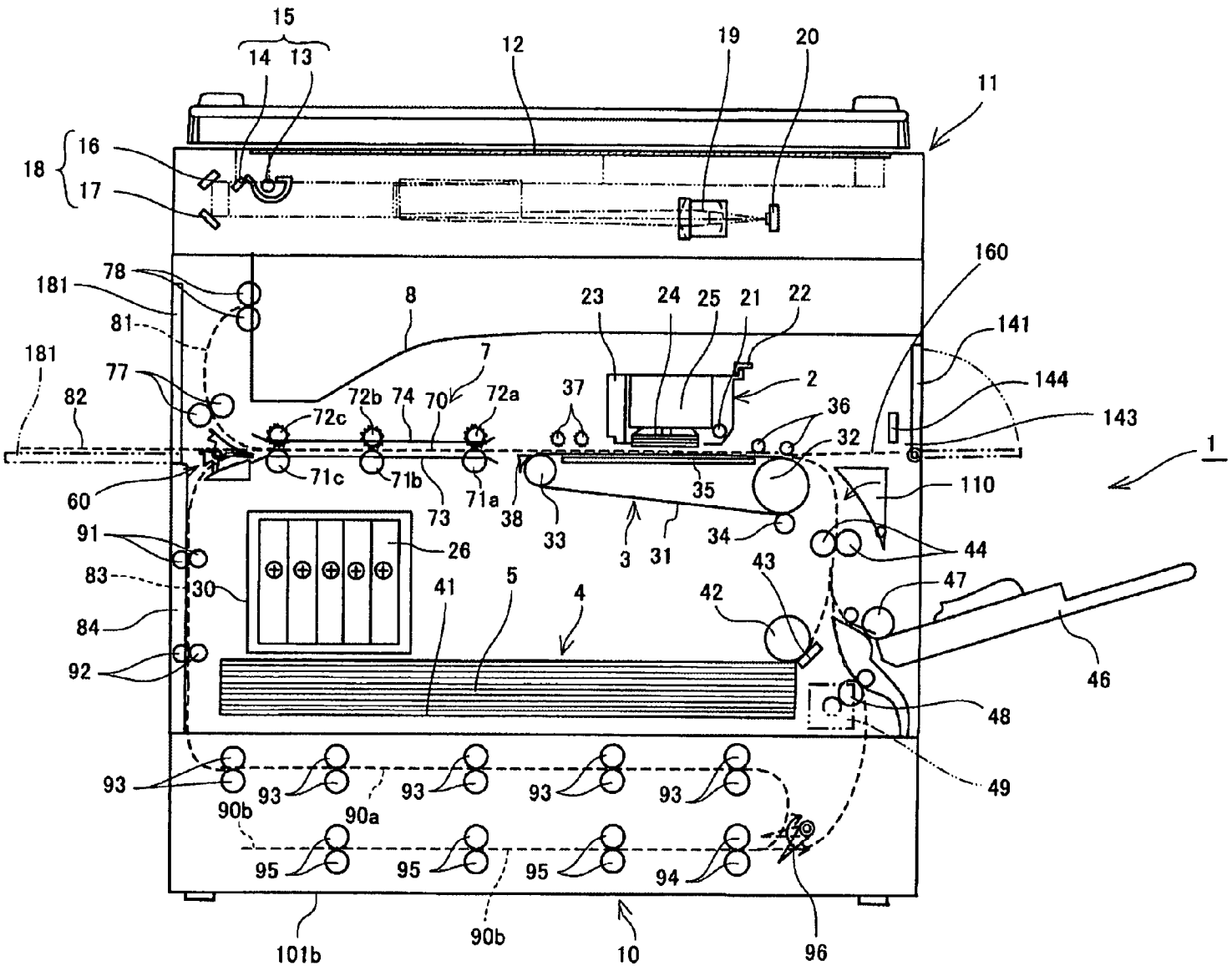
FIG. 1, is a diagram showing the outline of an image forming apparatus according to the present invention.
Figure 2:
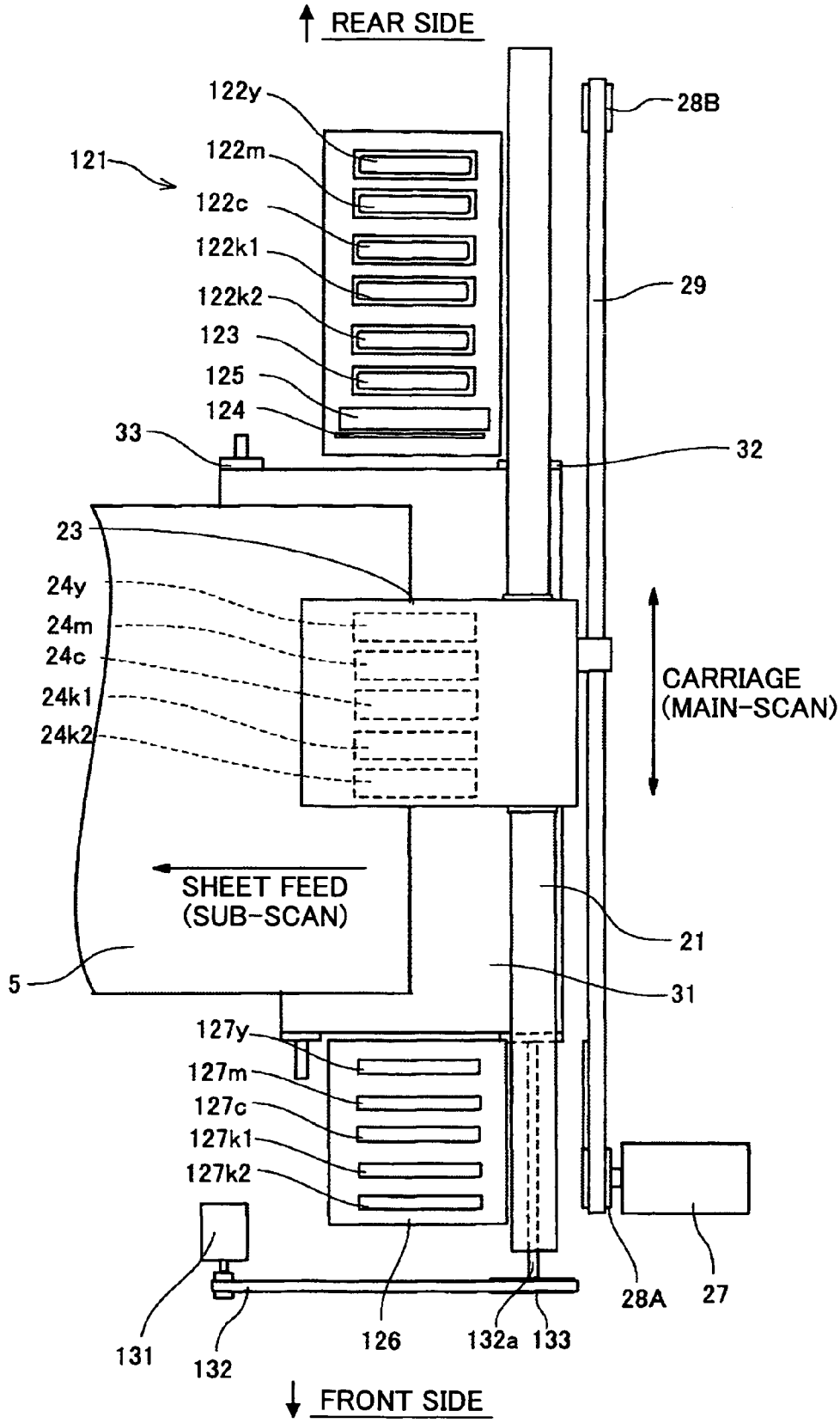
FIG. 2 is a plan view diagram showing an image formation part and a sub-scanning feeding part of the image forming apparatus of FIG. 1.
Figure 3:
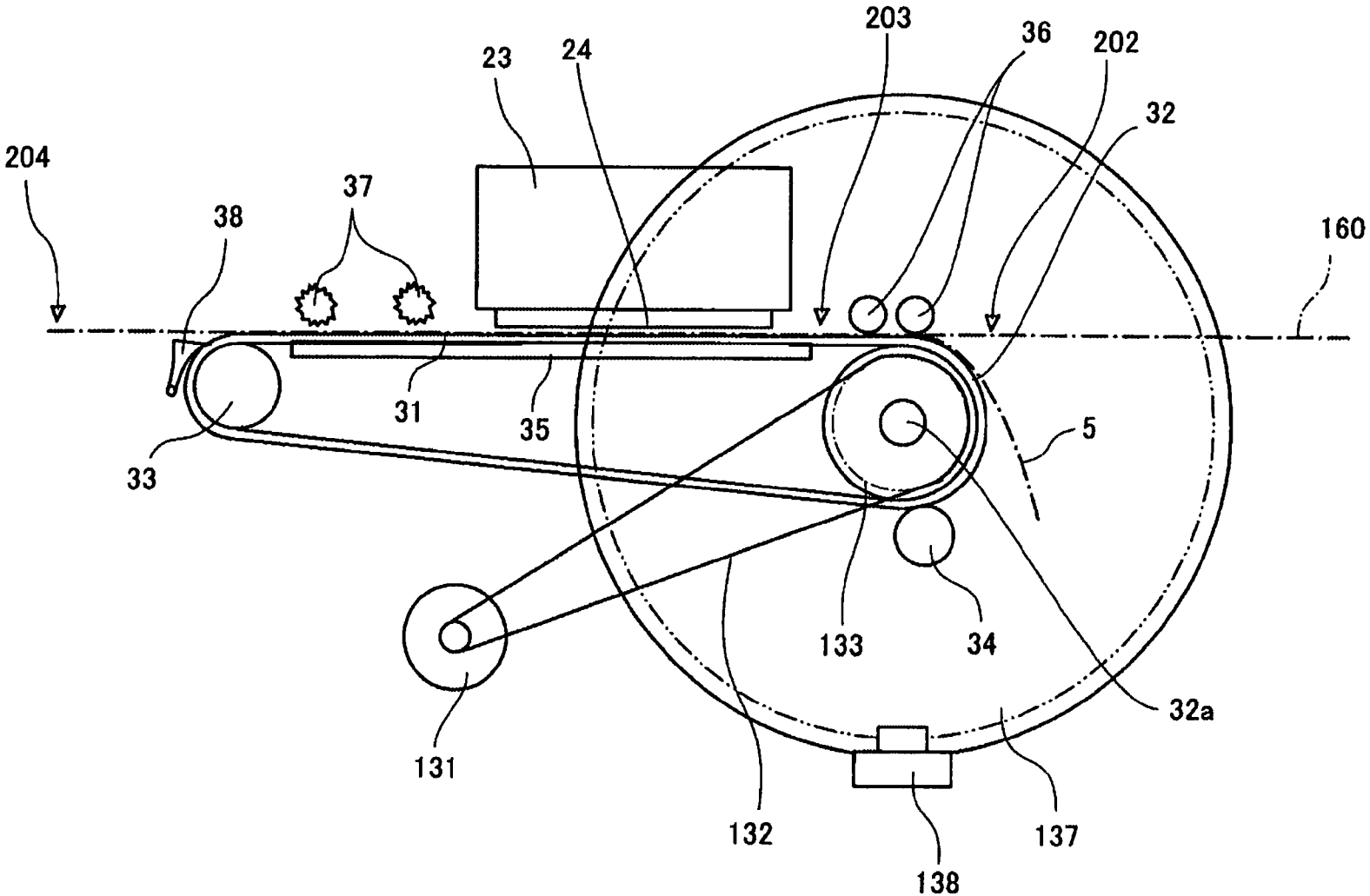
FIG. 3 is a front view diagram showing the sub-scanning feeding part.

FIGS. 1-3 show an embodiment of the image forming apparatus according to the present invention, wherein FIG. 1 shows the overall construction of the image forming apparatus, while FIG. 2 is a plan view diagram showing the image forming part and sheet feeding part used with the image forming apparatus of FIG. 1. Further, FIG. 3 shows a front view diagram of the sheet feeding part used with the image forming apparatus of the present invention.

Referring to the drawings, the image forming apparatus of the present invention includes an apparatus body 1, wherein the apparatus body 1 includes therein an image forming part 2 that forms an image on a recording sheet while feeding the recording sheet in a sub-scanning direction, and there is provided a sheet feeding part (sub-scanning feeding part) 3 also in the body 1 for feeding the recording sheet in the sub-scanning direction.

More specifically, the sheet feeding part 3 picks up a sheet 5 from a sheet feeding part 4 that includes a sheet feed cassette provided at a bottom part of the body 1 and feeds the sheet to a location facing the image forming part 2. Thereby, the image forming part 2 ejects droplets of a liquid and achieves formation of a desired image on the sheet 5, and the sheet 5 thus recorded with the image is discharged to a discharge tray provided at a top part of the body 1 via a sheet discharge feed part 7 in the case of forming images only on a front side of the sheet 5.

In the case of forming images also on a rear side of the sheet 5, the sheet 5 is sent to a dual-side unit 10 provided at a bottom part of the body 1 from the sheet discharge feed part 7, wherein the sheet 5 is turned over by a switchback feeding and is fed again to the sheet feeding part 3 in the turned back state. Thereby, recording of an image is conducted on the rear side of the sheet 5 by the image forming part 2, and the sheet 5 thus recorded with images at both sides is discharged to the discharge tray 8.

Further, the image forming apparatus of the present invention includes a scanner part 11 in the top part of the body 1 located above the discharge tray 8 as an input system for reading images, wherein the scanner part 11 is used for inputting image data for recording by the image forming part 2. It should be noted that the image reading part 11 includes an optical source 13 for illuminating the image to be scanned and a fixed optical system 15 including a mirror 14, wherein there is further provided a movable optical system 18 including mirrors 16 and 17, and reading of images is made from a manuscript placed on a contact glass 12. Thereby, the image on the manuscript is converted to an image signal 20 disposed behind a lens 19, and the image signal thus formed is subjected to image processing after digitization. Recording of the image is then conducted on the recording sheet 5 by using the image data thus obtained as the print data.

In addition, the image forming apparatus of FIG. 1 is capable of receiving image data (print data) to be recorded by the image forming part 2 from an external host device such as an information processing apparatus including a personal computer or an image reading apparatus such as an external image scanner, or from a picturing apparatus such as a digital camera, via a cable or network. Thereby, the image forming apparatus of FIG. 1 can print the received print data after appropriate processing.

Meanwhile, the image forming part 2 of the image forming apparatus includes a carriage 23 held movably in a main scanning direction by way of a guide rod 21 shown in FIG. 2 and a guide stay not illustrated, wherein carriage 23 is moved in the main scanning direction by a main scanning motor 27 via a timing belt 29 laid between a drive pulley 28A and a follower pulley 28B.

The carriage 23 carries thereon a recording head 24 ejecting the droplets of respective colors, and the image forming part 2 is thus configured in the form of a shuttle type image forming engine that achieves image formation on a sheet 5 fed to the recording head 24 in a sheet feed direction (sub-scanning direction) by a sheet feeding part 3 by the carriage 23 moved in the main scanning direction while ejecting the liquid droplets from the recording head 24 thereon.

It should be noted that the recording head 24 includes five liquid ejection heads, two of them (liquid ejection heads 24*k*1 and 24*k*2) ejecting black color inks (Bk), while the remaining liquid ejection heads 24*c*, 24*m* and 24*y* eject the inks of cyan (C), magenta (M) and yellow (Y), respectively. Collectively, these liquid ejection heads are designated as "recording heads 24". The liquid ejection heads 24 are supplied with inks of the respective colors from the corresponding sub-tanks mounted upon the carriage 23.

As shown in FIG. 1, it is possible to mount ink cartridges 26 loaded with inks of the respective colors, Bk, C, M and Y, detachably upon a cartridge loading part 30 from a front side of the body 1 of the image forming apparatus, and the inks of the respective colors are supplied to the corresponding sub-tanks 25 from the ink cartridges 26. Thereby, the black ink is supplied from one ink cartridge 26 to two sub-tanks 25.

For the recording head 24, it is possible to use a piezoelectric head that ejects ink droplets by using a piezoelectric element for the actuator means that applies a pressure to the ink inside an ink flow passage (pressure chamber) by causing deformation in a vibrator plate forming a wall of the ink flow passage. Alternatively, it is possible to use a thermal head that ejects ink droplets by the pressure of bubbles formed in the ink flow passage by heating the ink therein by way of a resistance heater. Further, it is possible to use an electrostatic head that includes an electrode facing the vibrator plate and ejects ink droplets by causing a deformation in the vibrator plate by the electrostatic force induced between the vibrator plate and the electrode such that the volume of the ink flow passage is changed.

In the body 1 of the image forming apparatus, there is provided a maintenance and recovery unit 121 that maintains and recovers operational state for the nozzles of the recording head 24 such that the maintenance and recovery unit 121 is disposed in a non-printing region at an end of the main scanning direction of the carriage 23.

It should be noted that this maintenance and recovery unit 121 includes: five humidity maintenance caps 122*k*2, 122*k*1, 122*c*, 122*m* and 122*y* (collectively designated as "humidity maintenance caps 122") respectively for the five recording heads 24; a suction cap 123; a wiper blade 124 for wiping the nozzle surface of the recording head 24, and a dummy ejection part 125 for receiving dummy ejection of the liquid droplets conducted for the purpose of maintenance of the recording head. This dummy ejection does not contribute to image recording.

Further, in a non-printing region at the other end of the scanning direction of the carriage 23, there is provided another dummy ejection part 126 for receiving dummy ejection of the liquid droplets from the five recording heads 24 not contributing to the image formation. This dummy ejection part 126 is formed with five openings 127*k*2, 127*k*1, 127*c*, 127*m* and 127*y* in correspondence to the recording head 24, wherein the openings 127*k*2, 127*k*1, 127*c*, 127*m* and 127*y* are also designated collectively as "opening 127".

As shown in FIG. 3, the sub-scanning feeding part 3 includes: an endless feeding belt 31 laid between a feeding roller 32 functioning as a drive roller and a follower roller 33 functioning as a tension roller, the endless belt 31 feeding a sheet 5 fed from a downward direction by deflecting the direction of feeding by about 90 degrees such that the sheet 5 is fed in a manner facing the image forming part 2; a charging roller supplied with high AC. voltage from a high voltage source and functioning as charging means for charging a surface of the belt 31; a guide member 35 guiding the feeding belt 31 in the region facing the image forming part 2; two urging (pressurizing) rollers 36 that urge the sheet 5 to the feeding belt 31 in the location where the sheet 5 faces the transpiration roller 32; two spur rollers 37 holding the top side of the sheet 5 on which image has been formed by the image forming part 2; and a separation nail 38 for separating the sheet 5 formed with images from the feeding belt 31.

It should be noted that this feeding belt 31 of the sub-scanning part 3 circles around in the sheet feeding direction (sub-scanning direction) of FIG. 2 with rotation of the feeding roller 32 caused by a sub-scanning motor 131 via a timing belt 132 and a timing roller 133. In the illustrated example, it should be noted that the feeding belt 31 has a two-layer structure comprising: a front surface layer functioning as the sheet suction surface and formed of a pure resin layer not subjected to resistance control such as a pure thermoplastic fluoro resin; and a rear surface layer of the same material as the front surface layer but subjected to resistance control by using carbon (medium resistance layer or grounding layer). Of course, the belt 31 is not limited to such a two-layer construction and it may have three or more layers or it may have a single-layer structure.

Further, the feeding roller 32 has a shaft 32*a* provided with a code wheel 137 of high resolution, wherein a photo sensor 138 of transmission type cooperates with the code wheel 137 for detecting the slits provided in the code wheel 137. Thereby, the code wheel 137 and the photo sensor 138 constitute a rotary encoder.

The sheet feeding part 4 comprises: a manual feed tray 46 for holding a stack of sheets 5; a manual feed roller 47 for picking up a sheet 5 one by one from the manual feed tray 46; and a feed roller 48 for feeding the sheet 5 fed from an optional sheet feed cassette mounted at a bottom part of the body 1 of the image forming apparatus or from a dual side unit 10 to be described later. It should be noted that the foregoing members such as the sheet feed rollers 42, the resist roller 44, the manual feed roller 47, the feeding roller 48, and the like, used for feeding the sheet 5 to the sub-scanning feeding part 3, are driven by a sheet feed motor (driving means) 49 of an HB-type stepping motor via an electromagnetic clutch not illustrated.

The sheet discharge feed part 7 comprises: three discharging rollers 71*a*, 71*b* and 71*c* (collectively designated also as "discharging rollers 71") for feeding the sheet 5 separated by the separation nail 38 of the sub-scanning feeding part 3 and spurs 72*a*, 72*b* and 72*c* (collectively designated also as "spurs 72") cooperating with the foregoing rollers 71*a*, 71*b* and 71*c*; a lower guide part 73 and an upper guide part 74 for guiding the sheet 5 fed between the discharging rollers 71 and the spurs 72; and a reverse roller pair 77 for sending the sheet 5 fed out along the path between the lower guide part 73 and the upper guide part 74 to the discharging tray 8 in a facedown state via a reversal discharging path 81, which functions as a first feeding path, after turning the sheet 5 upside down, and a reversal discharging roller pair 78.

Here, the feeding path of the sheet 5 between the lower guide 73 and the upper guide 74 is designated as a feeding path 70, wherein it should be noted that the feeding path 70 is provided with a length such that it takes a time sufficient for the image formed on the recording sheet 5 is dried to the degree that rubbing of the image does not take plate when the sheet is discharged along the feeding path 70.

Further, at the exit side of the feeding path 70, there is provided a switching mechanism 60 for switching the feeding path of the sheet 5 between the first path 81 for discharging the sheet to the discharging tray 8, a second path 82 used for discharging the sheet to a straight discharging tray 181, and a third path (dual-side discharging path) 83 for sending the sheet 5 to the dual-side unit 10.

It should be noted that the third path 83 extends vertically at the lateral side of the main body 1 of the image forming apparatus, and the sheet diverted by the switching mechanism 60 is fed to the dual-side unit 10 vertically along the path 83. Further, in order to feed the sheet 5 fed into the vertical sheet feed path 83, there are provided an inlet roller pair 91 and an outlet roller pair 92. Further, there is provided a guide plate 84 at the lateral part of the body 1 of the image forming apparatus for forming the vertical sheet feed path 83.

The dual-side unit 10 includes a horizontal take-up sheet feed path 90*a* for taking up and feeding the sheet 5 fed from the vertical sheet feed path 83 in a horizontal direction and a switchback feed path 90*b*. The horizontal take-up sheet feed path 90*a* comprises dual-side feed roller pairs 93, while the switchback feed path 90*b* includes a dual-side exit roller 94 formed of a reverse roller for re-feeding the sheet 5 fed from the take-up sheet feed path 90*a* after turning back and three dual-side feed roller pairs 95.

Further, in order to switch the sheet feed path of the sheet 5 from the take-up feed path 90*a* to the switchback feed path 90*b* and from the switchback feed path 90*b* to the feed roller pair 48 used for re-feeding, there is provided a movable diverting plate 96 in a manner to swing between two a first state shown in FIG. 1 by a continuous line for switchback and a second state shown in FIG. 1 by a broken line for re-feeding.

Further, the sheet 5 fed out from the dual-side unit 10 is forwarded to the resist roller 44 via the feed roller 48.

Further, there is provided a movable open/close guide plate 110 shown in FIG. 1 for forming a loop (relaxing) in the sheet 5 between the location of the feed roller 32 and the pressurizing roller 36 of the sub-scanning feed part 3 and the resist roller 44 and for preventing formation of back tension in the sheet 5 as the sheet 5 is fed from the manual feed tray 46 or the dual-side unit 10 and transported by the resist roller 44.

It should be noted that this open/close guide plate 110 guides the sheet 5, when sending the sheet 5 from the resist roller 44 to the sub-scanning feed part 3, by swinging in the direction of arrow from the illustrated state, while the open/close guide plate 110 returns to the illustrated state with the timing when the sheet 5 has reached the sub-scanning feed part 3 and allows formation of the loop.

With this image forming apparatus, there is also provided a manual feed tray 141 shown in FIG. 1 in a manner of movable between a closed state and opened state on a lateral side of the apparatus body 1 for enabling manual feeding of a sheet, wherein the manual feed tray 141 is opened to the state shown in FIG. 1 by a tow-dotted line when such manual feeding of a sheet is to be conducted. Thereby, it should be noted that the sheet 5 manually fed from the tray 141 is guided by the top surface of the open/close guide plate 110 and enters straight to the path between the feed roller 32 and the pressure roller 36 of the sub-scanning feed part 3.

Further, in order to discharge the sheet 5 straight after image formation, the body 1 of the image forming apparatus is provided with a straight discharge tray 181 at another lateral side of the apparatus body 1 also in a manner movable between a closed sate and opened state. Thus, by opening the straight discharge tray 181, there is formed a second, straight discharge path 82 that discharges the sheet 5, fed through the path between the lower guide part 73 and the upper guide part 74 of the sheet discharge feed part 7, straight to the tray 181.

With this, it becomes possible to transport the sheet 5 straight from the manual feed tray 141 to the straight discharge tray 141 without bending the sheet 5, while this mode of sheet feeding is useful when using a thick sheet or OHP sheet, which is difficult to be deflected. Of course, this sheet feed mode can be used also for ordinary sheets such as ordinary paper.

In operation, the charging roller 34 is applied with a high AC voltage of the form of positive and negative rectangular pulses from an AC bias source not illustrated, and with this, there are induced positive and negative charges on the insulating front surface of the feed belt 31 alternately in the form of bands with a predetermined bandwidth. Thereby, there is induced non-uniform electric field.

Thus, when a sheet 5 is fed to such a belt 31 from any of the sheet feed part 4, manual feed part 46, dual-side unit 10, manual feed tray 141, and the like, through the path between the feed roller 32 and the pressure roller 36, the non-uniform electric field on the feed belt 31 instantaneously induces corresponding polarization in the sheet 5, and the sheet 5 is sucked to the feed belt 31 by the electrostatic force. Thereby, the sheet 5 is transported with movement of the belt 31.

Thus, the sheet 5 is fed intermittently with the feed belt 31 and recording of images is achieved on the surface of the sheet 5 by the droplets of the liquid ejected from the recording head 24 in accordance with the print data. The sheet 5 thus recorded with the image is then separated from the feed belt 31 by engaging the separation nail 38 with the tip end of the sheet 5, and the sheet 5 thus separated is discharged to any of the discharge tray 8 or the straight discharge tray 181 or fed to the dual-side unit 10 for image recording on the rear side.

Figure 4:
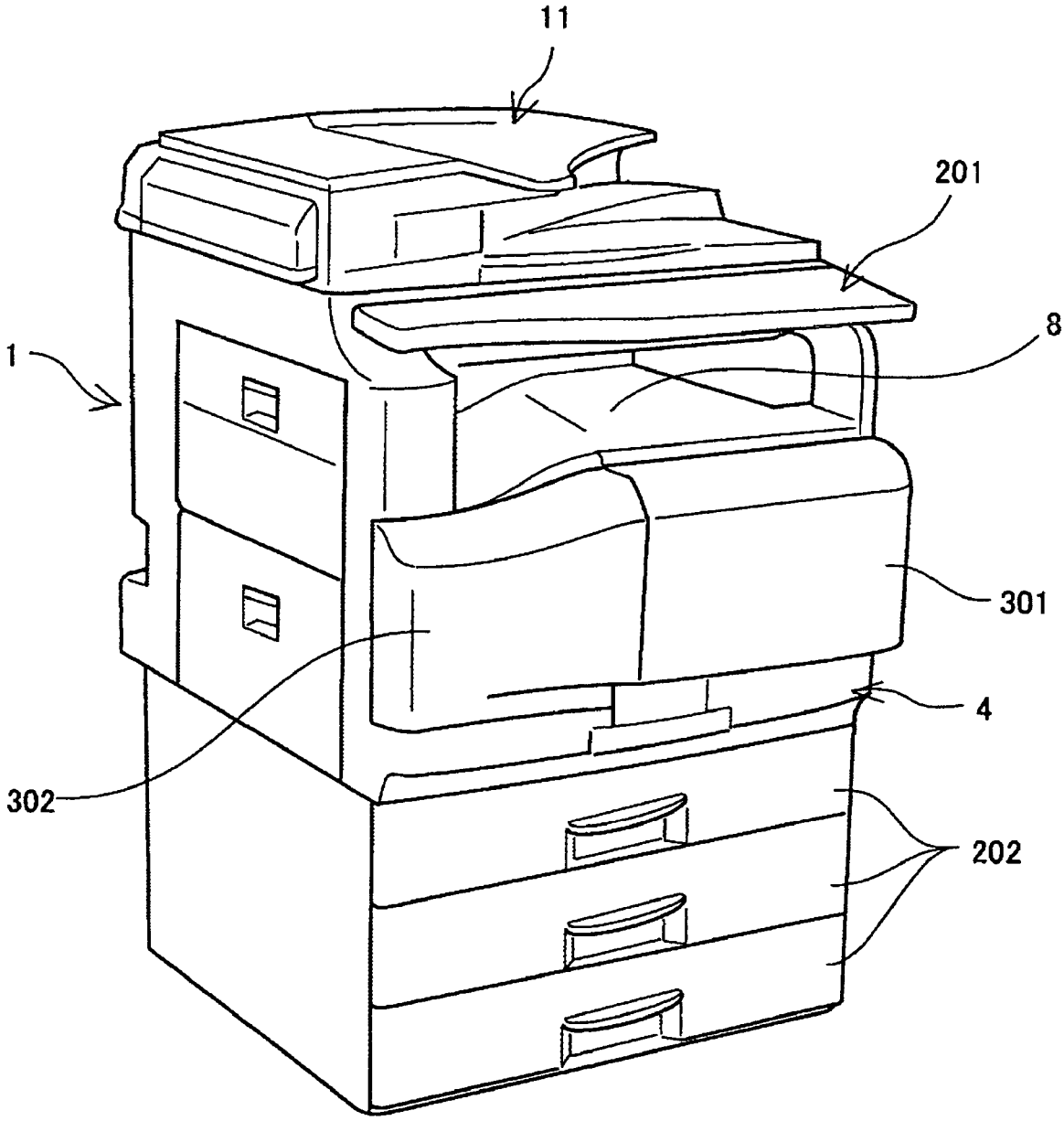
FIG. 4 is an oblique view diagram showing the overall construction of the image forming apparatus.
Figure 5:
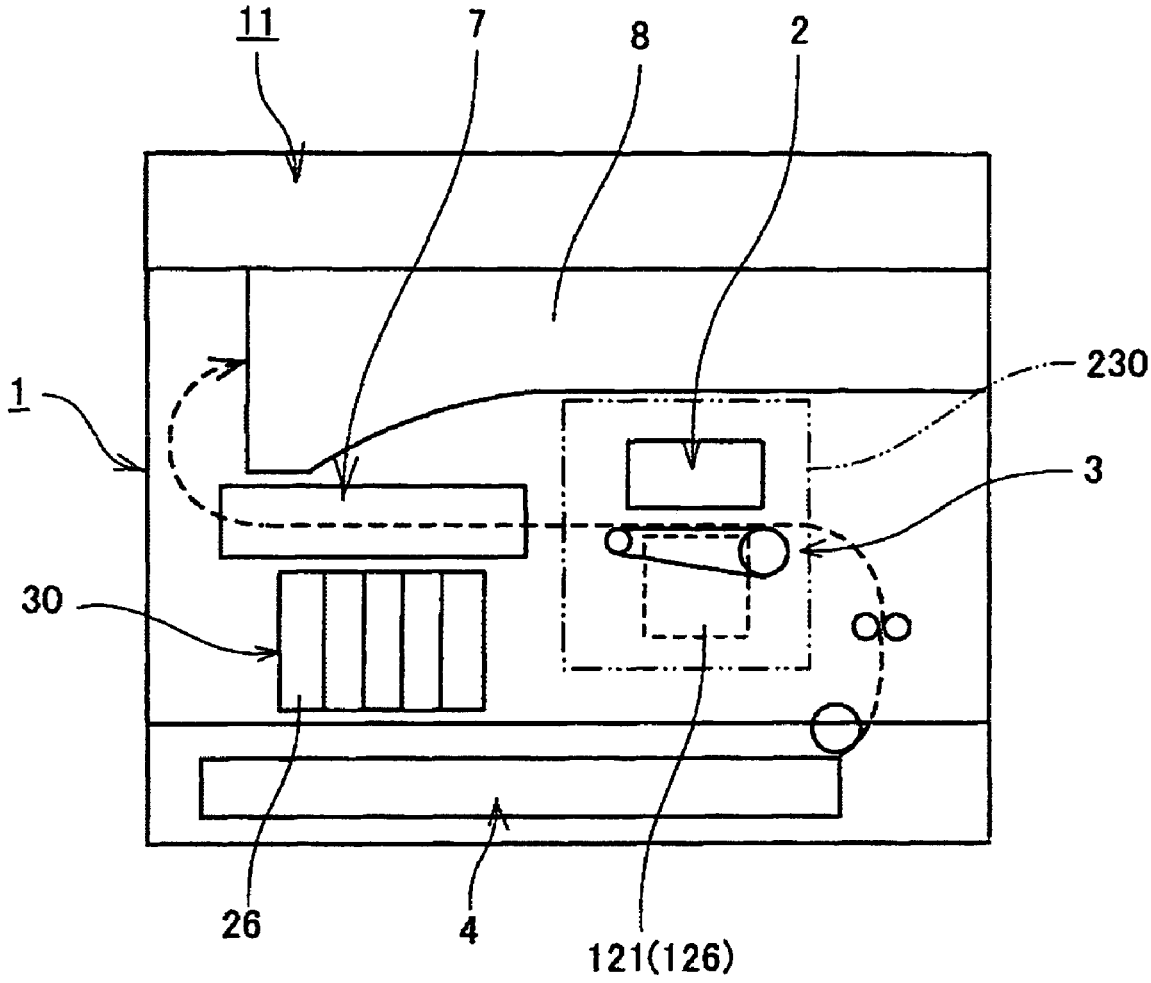
FIG. 5 is a schematic front view diagram showing the layout of the image forming apparatus of the present invention.
Figure 6:
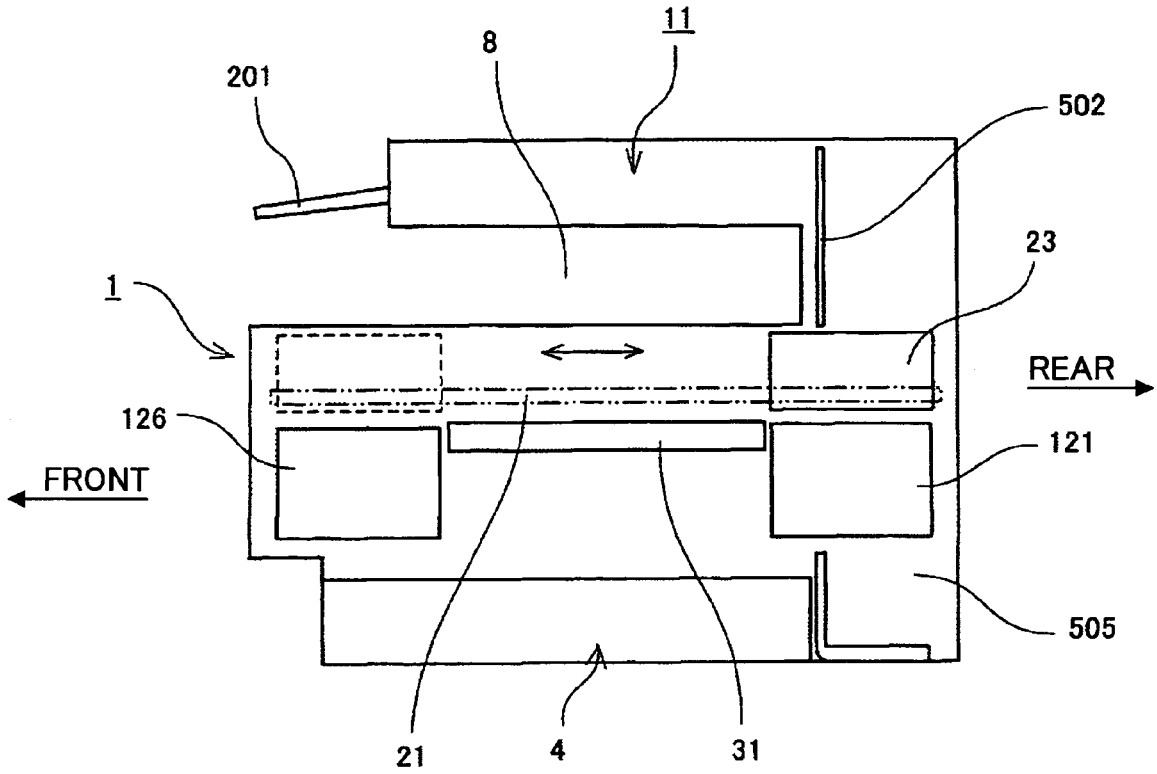
FIG. 6 is a side view diagram of the image forming apparatus of the present invention as viewed from a right direction.
Figure 7:
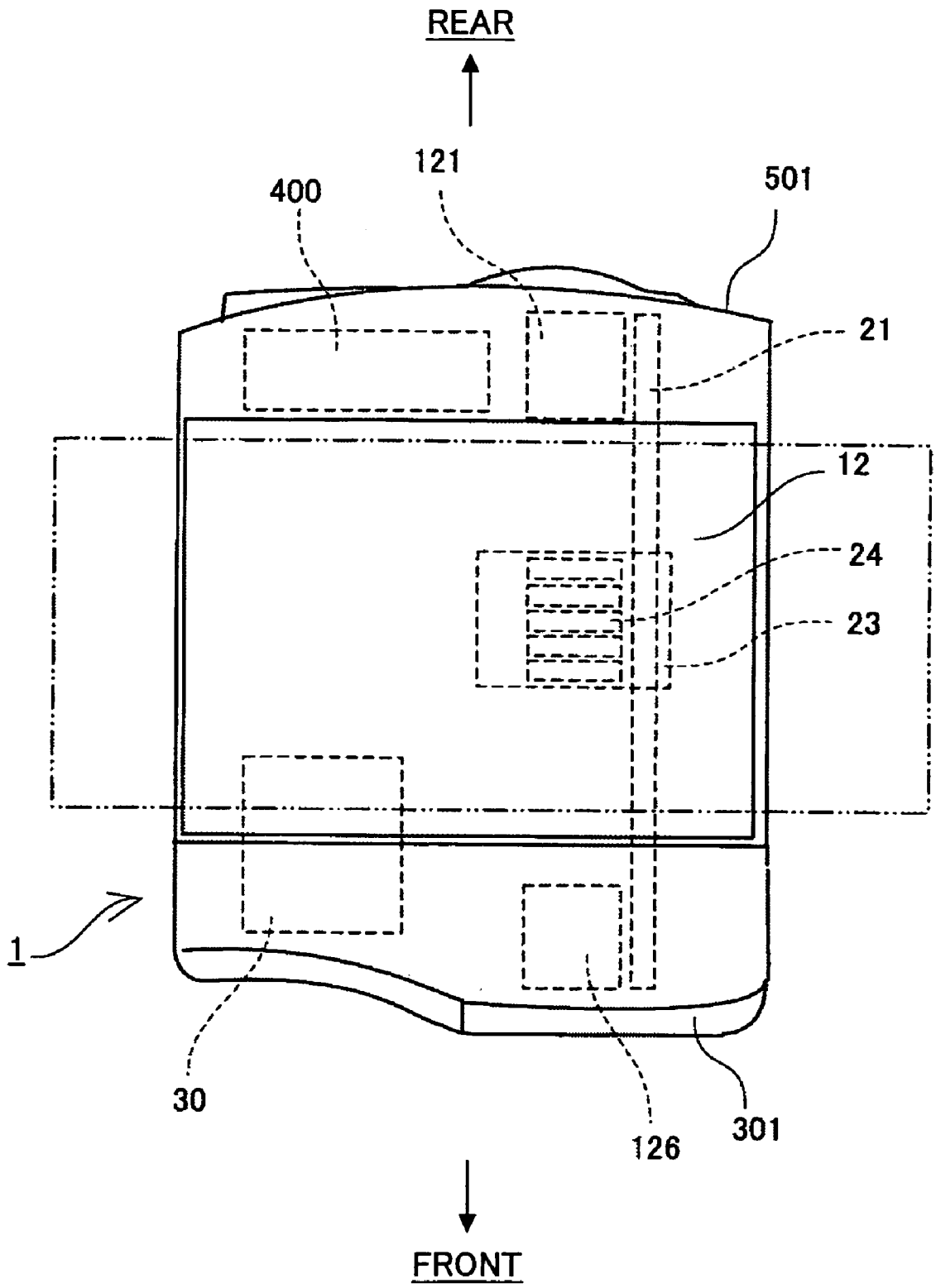
FIG. 7 is a schematic plan view diagram showing the image forming apparatus of the present invention.

Next, layout of various components in the image forming apparatus will be explained with reference to FIGS. 4-8, wherein it should be noted that FIG. 4 shows the image forming apparatus in an oblique view, while FIG. 5 is a front view diagram for explaining the layout of various components of the image forming apparatus. Further, FIG. 6 is a schematic diagram of the image forming apparatus as viewed from a right direction, while FIG. 7 is a schematic plan view of the image forming apparatus. Further, FIG. 8 shows the engine unit in an oblique view.

Figure 8:
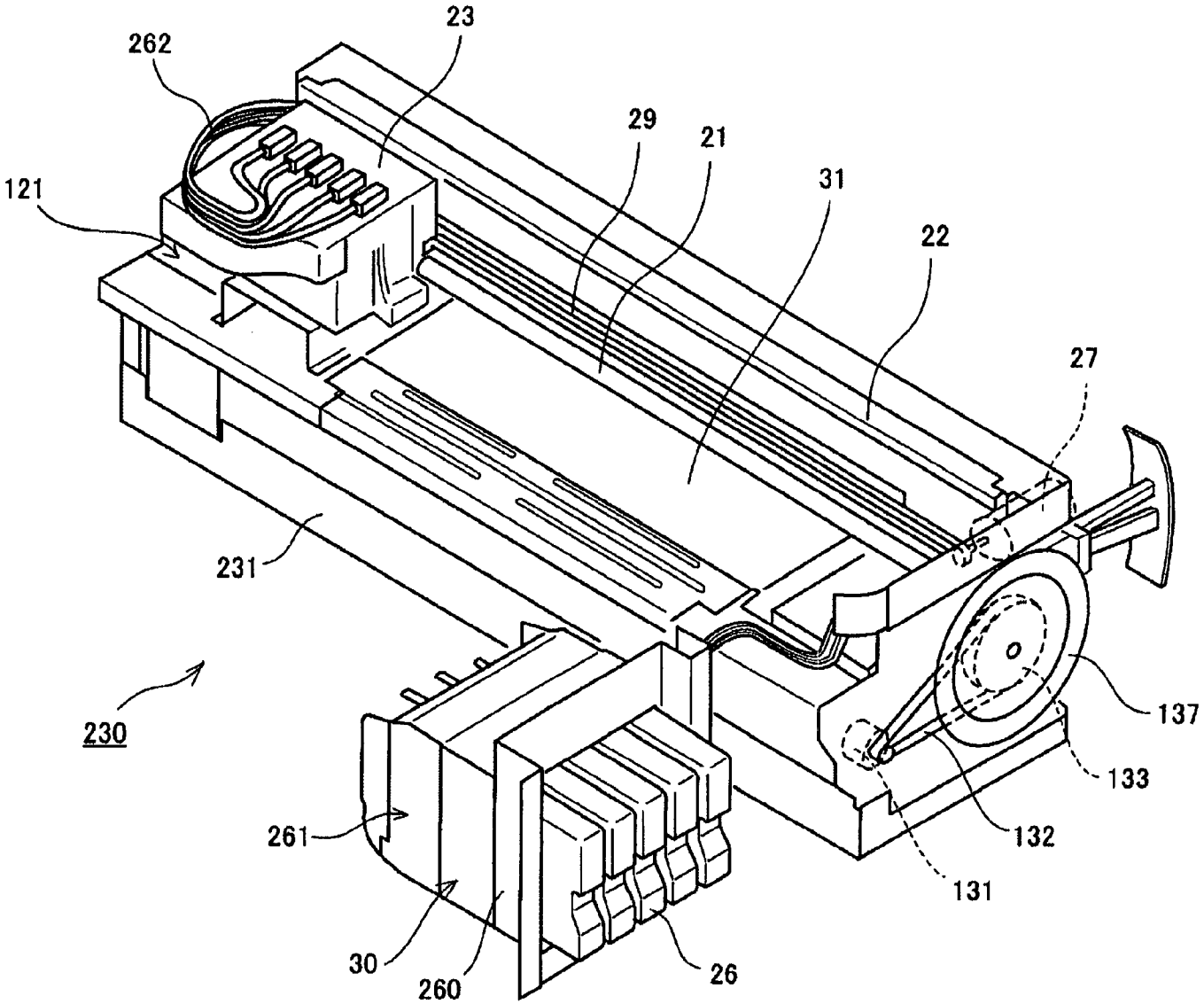
FIG. 8 is an oblique view diagram showing an engine unit of the image forming apparatus of the present invention.

The image forming apparatus integrates the image forming part 2 and the sub-scanning feed part 3 in the form of an engine unit (engine part) 230 as shown in FIG. 8, and engine unit 230 is disposed inside the apparatus body 1 together with the sheet feed part 4 and the sheet discharge feed part 7, wherein the image reading part 11 is disposed at the top part of the apparatus body 1 and the sheet discharge part (discharge tray) 8 is provided in the upper part of the apparatus body 1 for discharging the sheet.

In the front side of the apparatus body 1, there is provided an operational panel 201 above the discharge tray 8 for providing instructions to the various parts of the image forming apparatus including the image reading part 11 and for displaying various information, wherein the operational panel 201 is provided in a manner that the tilt angle thereof can be adjusted. In the illustrated example, there are provided optional sheet feed trays 202 in the lower part of the apparatus body by replacing the dual-side unit 10 in the form that the plural sheet feed trays 202 are stacked with each other.

Further, at the front side of the apparatus 1, there are provided a right front cover 301 in a manner that the right front cover 301 is opened and closed, wherein the cover 301 is provided for mounting and dismounting the engine unit 230, in which the image forming part 2 and the sub-scanning feed part 3 are integrated, to and from the apparatus body 1. Further, there is provided a left front cover 302 capable of being opened and closed for enabling replacement of the ink cartridges 26 with regard t the cartridge loading part 30.

In the illustrated example, it should be noted that, when the image forming apparatus is viewed from the top direction in a plan view, the right front cover 301 bulges more in the front direction as compared with the left front cover 302 in correspondence to the dummy ejection part 126 of the engine unit provided in correspondence to this part as shown in FIG. 7 (see also FIG. 2), and the left front cover 301 corresponding to the ink cartridges 26 is receded relatively to the right front cover 203. With this, the area occupied by the apparatus body 1 is reduced.

Thus, in the present embodiment, the engine unit 230 is disposed at the right side in the apparatus body 1 when viewed from the front direction, and the sheet discharge feed part 7 having the feed path 70, which feeds the sheet 5 straight after image formation by the engine unit 230, is disposed sideways to the engine unit 230. Further, the cartridge loading part 30 for loading the ink cartridge 26 detachably is disposed underneath the sheet discharge feed part 7.

Thus, by providing the straight feed path 70 of the sheet discharge feed part 7 such that the sheet 5 is fed straight inside the apparatus main body 1 after image formation with the engine unit 230, it becomes possible to secure sufficient time for the ink applied to the sheet 5 is dried after imaged formation, before the sheet 5 is discharged to the discharge tray 8 in the turned-over state, and it becomes possible to eliminate the problem of degradation of image quality caused by rubbing of still wet images.

When the sheet 5 is discharged immediately after image formation to the discharge tray 8 in the turned over state, on the other hand, there is a need of supporting the surface of the sheet, which carries thereon still wet images, by means of rollers, while such contact of the wet sheet surface with rollers may result in degradation of image quality as a result of rubbing made by the contact with the rollers. The present invention successfully avoids this problem by providing the sheet discharge feed part 7 that feeds the sheet straight after image formation by the image forming unit in the state that the image formation surface faces in the upward direction, it becomes possible to secure the time needed for drying the recording liquid applied upon the sheet surface. Thereafter, the sheet is turned over for discharging upon the tray 8. With such operation, applied to the dried sheet, there is caused no problem of degradation of image quality.

Further, by disposing the cartridge loading part 30 used for mounting the ink cartridges 26 underneath the sheet discharge feed part 7, the space underneath the sheet discharge feed part 7 is utilized efficiently, and it becomes possible to reduce the space of the apparatus body 1 in the front-rear direction.

In the case of image forming part of serial scanning type, the scanning region of the carriage 23 becomes inevitably larger than the width of the normally used sheet in view of the need of providing the maintenance and recovery unit 121 and the dummy ejection part 126 for maintaining and recovering the function of the recording head 24 as noted before. Thus, with the construction of disposing the carriage 23 with an orientation such that scanning is made in the front-rear direction of the apparatus main body 1, it is inevitable to dispose the maintenance and recovery unit 121 and the dummy ejection part 126 in the front-rear direction, such that the maintenance and recovery unit 121 is disposed at the rear side and the dummy ejection part 126 is disposed at the front side, for example.

When the image forming apparatus is the one having the construction in which the ink tanks are mounted upon the carriage 23, there is no need of providing the loading part for loading the ink cartridges at the front side of the apparatus body 1, while with the image forming apparatus of the present invention that uses sub-tanks, there is a need of providing the loading part for loading the ink cartridges at the front side of the apparatus body 1.

Now, when this ink cartridge loading part is disposed underneath the engine unit 230, it will be noted that the height of the apparatus body 1 becomes unnecessarily large particularly with the construction in which the maintenance and recovery unit 121 or the dummy ejection part 126 is disposed at respective sides of the carriage main scanning direction. Further, in the case of the image forming apparatus in which the engine unit 230 is detachable with regard to the apparatus main body 1 as in the present case, it is not possible to dispose the ink cartridge loading part at the front side of the engine unit 230.

By disposing the ink cartridge loading part 30 in the space underneath the sheet discharge feed part 7 at the lateral side of the engine unit 230 inside the apparatus main body 1 as viewed from the front direction of the apparatus body 1 as shown in FIG. 5, it becomes possible to dispose the ink cartridge loading part 30 without increasing the height or lateral size of the apparatus body 1. Further, as shown in FIG. 7, it becomes possible to reduce the size of the apparatus body 1 in the front-rear direction by disposing the ink cartridge loading part 30 to be located inside the sheet feed path as viewed in the plan view. Further, such a construction can use the space underneath the sheet discharge feed part 7 by providing the sheet discharge feed part 7 for securing the time needing for drying the applied liquid.

Further, with the image forming apparatus of the present invention, it should be noted that, in addition to the fact that the cartridge mounting part 30 is disposed at the front side of the apparatus 1, the circuitry part 400 that generates heat is disposed at the opposite, rear side of the apparatus body 1 as shown in FIGS. 7 and 5.

Generally, it is inevitable that there occurs heat generation with image forming apparatuses from a power supply unit or control substrate. Thus, when the circuitry part 400 is disposed underneath the maintenance and recovery unit 121 of the image forming apparatus 2 that processes the recording liquid, the maintenance and recovery unit 121 or the recording heads 24 standing therein experience heating with the heat generated with the circuitry part 400 and moving upward in the body 1. Thereby, drying of the recording liquid is facilitated and there tends to occur problems such as clogging of the recording heads 24.

With the image forming apparatus of the present invention, it is not only that the space formed by disposing the recovery and maintenance unit 121 and the dummy ejection part 126 at opposite sides in the main scanning direction is utilized efficiently, but the circuitry part 400 that includes components generating heat is disposed at the rear side of the apparatus body 1 opposite to the cartridge loading part 30 and at the lateral side of the maintenance and recovery unit 121 for suppressing the effect of heat upon the maintenance and recovery unit 121 of the image forming part 2.

With this case, it is preferable that the circuitry part 400 includes at least the power supply unit and control substrate that tend to generate substantial heat.

Next, the engine unit 230 will be explained briefly with reference to FIG. 8. As explained before, the engine unit 230 integrates the image forming part 2 and the sub-scanning part 3 for facilitating loading and unloading to and from the apparatus body 1 for improved easiness of maintenance.

With the image forming apparatus of the present invention that uses sub-tanks on the carriage 23, the ink cartridge loading part 30 includes a frame 260 on which the ink cartridges 26 are loaded and a supply mechanism 261 for feeding out the ink in the ink cartridges 26 for supplying the ink to the sub-tanks 25 from the ink cartridges 26 mounted upon the carriage 23, wherein the supply mechanism 261 feeds the ink to the sub-tanks 25 on the carriage 23 by way of five tubes 262.

Now, there arises a problem, when it is constructed that there is a need of dismounting the ink supply paths extending from the ink cartridge loading part 30 to the sub-tanks 25 on the carriage 23 via the tubes 262 when mounting or dismounting the engine unit 230 to or from the apparatus body 1, in that dusts or particles tend to penetrate to the ink supply passage, resulting in blocking of liquid supply in the ink supply passages.

Thus, with the present invention, the frame 260 of the ink cartridge loading part 30 is fixed upon the frame 231 of the engine unit 230, and the ink cartridge 26 and the engine unit 320 are integrated to form a unit. With this construction, there is no need of dismounting the ink supply paths when the engine unit 230 is mounted to or dismounted from the body 1, and penetration of dusts or particles to the ink supply paths is positively prevented.

Figure 9:
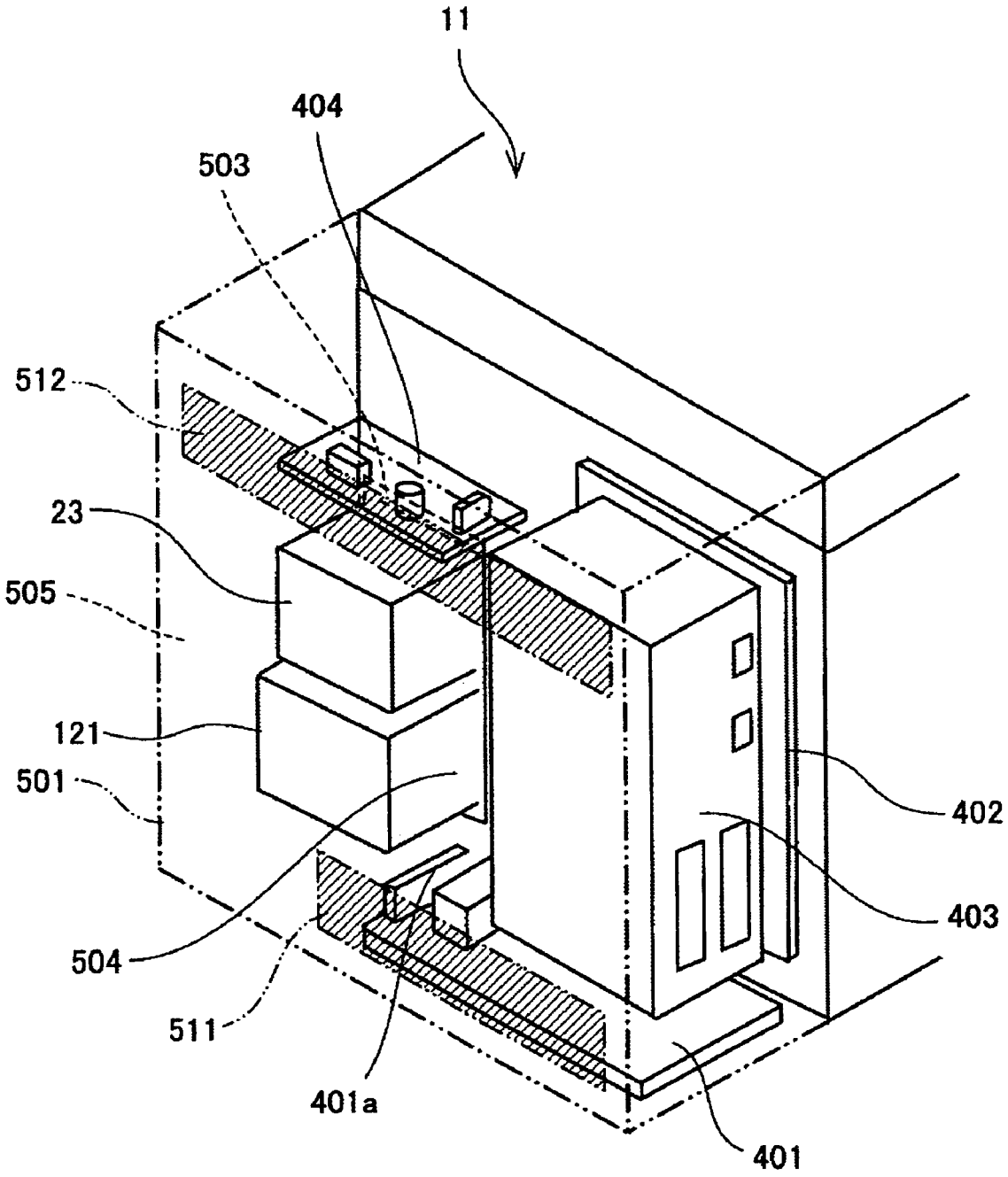
FIG. 9 is an oblique view diagram showing the rear part of the image forming apparatus of the present invention.
Figure 10:
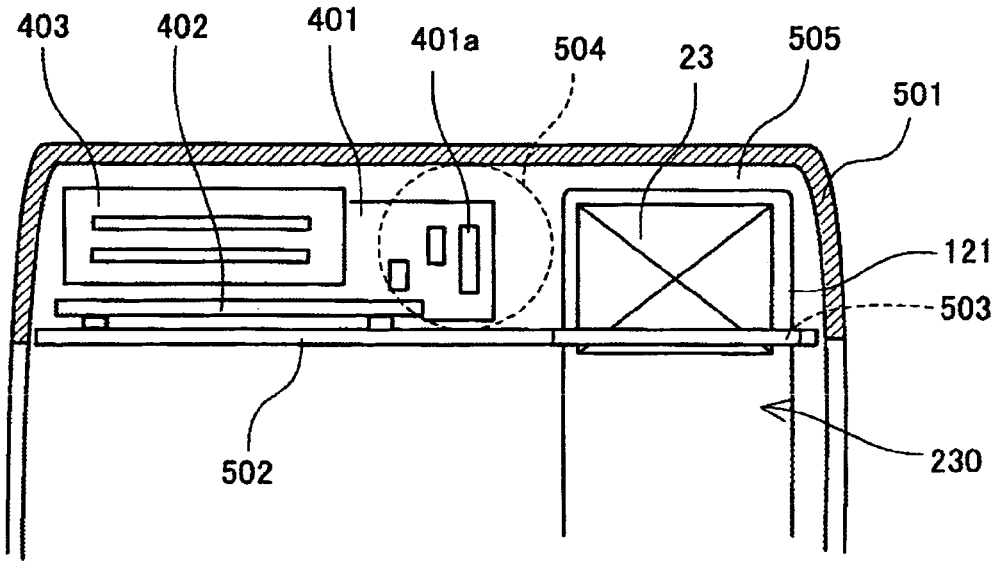
FIG. 10 is a plan view diagram showing the rear part of the image forming apparatus of the present invention.

Next, the construction of the apparatus body at the rear side including the circuitry part 400 will be explained with reference to FIGS. 9-11, wherein it should be noted that FIG. 9 is an oblique view showing the rear part while FIG. 10 is view of the rear part of the apparatus body 1.

Referring to the drawings, it can be seen that the maintenance and recovery unit 121 is disposed between a rear cover 501 and a side plate 502 of the apparatus body 1, and the side plate 502 is formed with an opening 503 for mounting and dismounting the engine unit 230.

Further, there is provided a space 504 at the lateral side of the maintenance and recovery unit 121 such that the space 504 is not provided with a component extending in the vertical direction. Further, the circuitry part 400 is disposed at the under side and lateral side of this space 504.

Thus, a power supply unit 401 that constitutes the circuitry part 400 and includes components 401*a* that generates heat is disposed at the under side to the lateral side of the space 504 where no component is provided. Further, there are provided a control substrate 402 carrying thereon a control part for controlling the overall operation of the image forming apparatus and an image forming substrate 403 carrying thereon an engine control part (image formation control part) that controls each part of the engine unit 230 in the space 504 over the power supply unit 401 so as to extend vertically along the space 504. Further, a drive substrate 404 carrying a drive circuit of motors is disposed over the maintenance and recovery unit 121.

Figure 11:
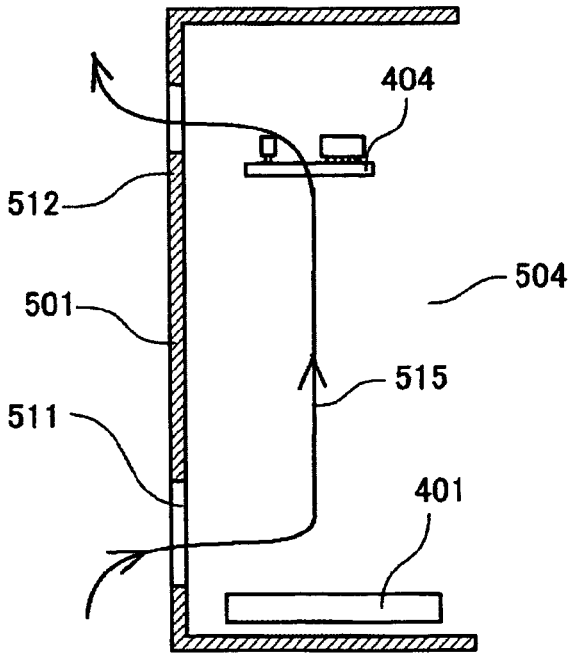
FIG. 11 is a schematic side view diagram showing the rear part of the image forming apparatus of the present invention.

Further, as shown in FIG. 11, there is formed a lower opening 411 (shown with hatching in FIG. 9) on the rear cover 501 at a lower lateral part thereof so as to provide communication between the space 504 and the exterior of the apparatus body 1, and there is further provided an upper opening 512 (shown with hatching in FIG. 9) on the rear cover 501 at an upper lateral part thereof so as to provide communication between the space 501 and the exterior of the apparatus body 1. Here, it should be noted that the lower opening 511 is formed with a width (lateral direction of FIG. 7) generally equal to the width of the power supply unit 401, while the upper opening 512 is formed with a width generally equal to the width of the apparatus body 1. Reference should be made also to FIG. 9.

Thus, the power supply unit 401 that includes heat-generating elements such as coils and transistors is disposed right underneath the space 504, and the control substrate 402 and the image forming substrate 403 are disposed so as to extend vertically along the space 504.

Thus, in the space 504, there is induced an air flow (convection) rising in the upward direction by the heat generated by the elements such as coil or transistor of the power supply unit 401 disposed in the lower part, wherein this rising air flow induces suction of external air through the lower opening 511. Further, the air thus introduced and warmed by the heat is discharged to the outside of the apparatus body 1 through the upper opening 512. Thus, the circuitry part 400 is cooled with such natural convention or rising air flow.

Because the foregoing space 504 is surrounded by the maintenance and recovery unit 121, the carriage located in the home position, the control substrate 402, the image forming substrate 403, the rear cover 501 and the side plate 502, the space 504 functions as a chimney and it was in fact confirmed that there is induced a fast air flow streaming in the upward direction by the heat generated by the power supply unit 401 located at the bottom part of the body 1. With such a construction, it is possible to cool the circuitry part 400 effectively without using blowing means such as a fan.

Figure 12:
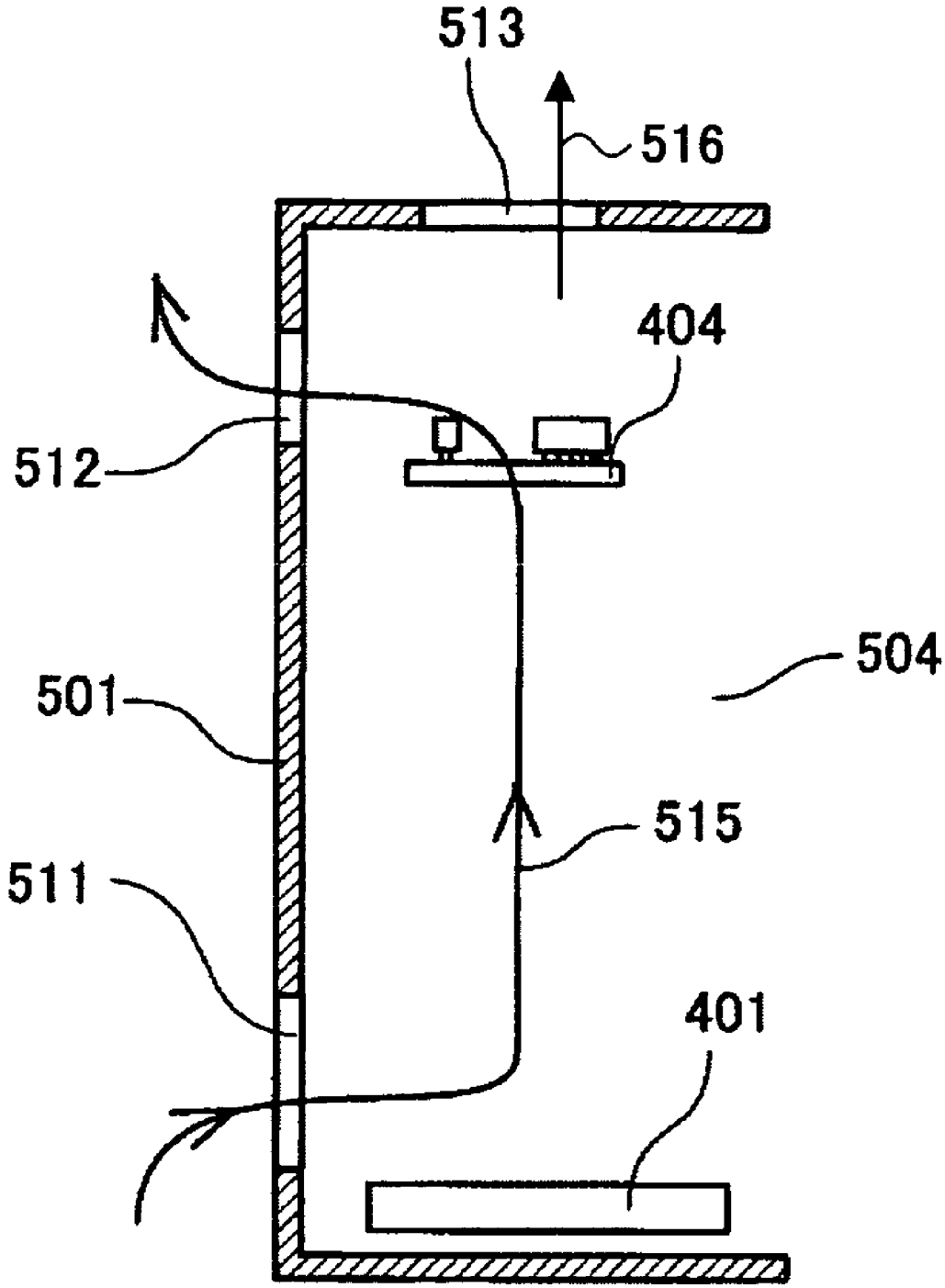
FIG. 12 is a schematic side view diagram showing another example of the rear part of the image forming apparatus of the present invention.

With the present embodiment, it is also possible to provide an opening 513 on upper part of the rear cover 501 in correspondence to the region above the space 504 or the driver substrate 404 so as to induce an air flow 516 flowing through the opening 513 to the exterior of the space 504 as represented in FIG. 12.

At the time of image forming operation, the carriage 23 is moved back and forth in the direction of arrows shown in FIG. 6 for formation of the images, and thus, the carriage 23 moves in and out a chamber 505 defined in the apparatus body 1 by the frame (side plate) 502 and the rear cover 501, wherein negative pressure and positive pressure induced in the chamber 505 with the in/out movement of the carriage 23 provides turbulence in the air inside the chamber 505. Air flow induced with such air turbulence also contributes to the cooling of the circuitry part 400.

It should be noted that, while the carriage is held on the maintenance and recovery unit 121 in the non-printing state for stand by, it is also possible to move the carriage 23 back and forth also in the non-printing state of the image recording apparatus when a temperature sensor provided on the control substrate 402 has provided an output. Alternatively, it is possible to obtain similar effect also during the printing operation by moving the carriage back and forth while holding the feeding of the sheet.

Further, the present invention is by no means limited to the embodiments described heretofore, but various variations and modifications may be made without departing from the scope of the invention.

The present invention is based on Japanese priority application No. 2005-048436 filed on Feb. 24, 2005, which is incorporated herein as reference.

What is claimed is:

1. An image forming apparatus, comprising:

a body;

an engine part provided in said body, said engine part including a recording head that ejects droplets of a recording liquid and a medium feeding part that feeds said medium to a location facing to said recording head, said engine part recording an image on a recording medium by said recording head while feeding said recording medium to said recording head by said medium feeding part;

a medium discharging part provided in said body at a side of said engine part, said medium discharging part including a straight feed path which feeds said recording medium straight after recording of said image with said engine part and a curved path provided next to said straight feed path, said curved path turning said recording medium having the image recorded thereon up-side-down;

a medium receiving part that receives said recording medium turned up-side-down by said medium discharging part; and a cartridge loading part that holds a cartridge of said recording liquid in a detachable manner, said cartridge loading part being provided in said body of said image forming apparatus and feeding said recording liquid to said recording head of said engine part, wherein said cartridge loading part is provided underneath said straight feed path and is not provided underneath said medium feeding part of said engine part.

2. The image forming apparatus as claimed in claim 1, wherein said engine part forms a unit detachable to and from said body of said image forming apparatus.

3. The image forming apparatus as claimed in claim 1, wherein said engine part includes a maintenance and recovery mechanism that maintains said recording head operational.

4. The image forming apparatus as claimed in claim 1, wherein said medium, discharging part turning said recording medium having the image recorded thereon up-side-down and discharging said recording medium to said medium receiving part.

5. The image forming apparatus as claimed in claim 1, wherein said cartridge loading part is disposed at a front side of said body, said image forming apparatus including a part that generates heat such that said part is provided in said body at a rear side of said body.

6. The image forming apparatus as claimed in claim 5, wherein the part that generates heat is disposed opposite to said cartridge loading part.

7. The image forming apparatus as claimed in claim 5, wherein said part that generates heat is at least one of a power supply unit and a control board of said image forming apparatus.

* * * * *